United States Patent [19]

Stolarczyk

[11] Patent Number: 4,462,022

[45] Date of Patent: Jul. 24, 1984

[54] SECURITY SYSTEM WITH RADIO FREQUENCY COUPLED REMOTE SENSORS

[75] Inventor: Larry G. Stolarczyk, Raton, N. Mex.

[73] Assignee: A. R. F. Products, Inc., Raton, N. Mex.

[21] Appl. No.: 320,556

[22] Filed: Nov. 12, 1981

[51] Int. Cl.[3] ..... G08B 29/00

[52] U.S. Cl. ..... 340/506; 340/518; 340/539; 340/825.06

[58] Field of Search ..... 340/536, 539, 825.06, 340/506, 518

[56] References Cited

U.S. PATENT DOCUMENTS

| | | | |
|---|---|---|---|
| 3,701,019 | 10/1972 | Jackson | 340/506 X |
| 3,792,469 | 2/1974 | McLean et al. | 340/518 |
| 3,866,217 | 2/1975 | Bennett | 340/506 X |
| 3,902,478 | 9/1975 | Konopasek et al. | 340/539 X |
| 3,925,763 | 12/1975 | Wadhwani et al. | 340/539 X |
| 4,347,501 | 8/1982 | Akerberg | 340/536 X |

*Primary Examiner*—David L. Trafton

*Attorney, Agent, or Firm*—Burmeister, York, Palmatier, Hamby & Jones

[57] ABSTRACT

A wireless security system in which a sensor for detecting a security violation is provided with a radio frequency transmitter adapted to excite the receiver of a control unit at a different location, the transmitter of the sensor radiating a signal responsive to the occurrence of a security violation. The sensor also having means to periodically excite the transmitter after the lapse of a period of time to indicate that the sensor is in proper working order, that period varying randomly. The control unit is provided with a memory and stores responses to the random signals, and at intervals long with respect to the random periods, samples the memory. The control unit responds to the absense of a stored response from the transmissions of the sensor.

In a preferred construction, a plurality of sensors are employed with a single control unit, each of the sensors radiating a unique encoded signal. The control unit may thus determine by sampling which of the sensors has failed to radiate a signal received by the control unit during the sampling interval of the control unit.

5 Claims, 4 Drawing Figures

SECURITY SYSTEM WITH RADIO FREQUENCY COUPLED REMOTE SENSORS

The present invention relates to security systems for residential and industrial use, and in particular to such security systems employing a master control unit and a plurality of sensors remote from the master control and coupled to the master control by radio frequency communication.

Electronic security devices are readily available in the marketplace for use in both residential and commercial establishments. Such devices generally employ a sensor at each door or window of the building to be secured, and these sensors are coupled to a master control which processes the information from the sensors. If the sensor signal indicates an intrusion, a fire, or other condition to be monitored, the master control actuates an alarm, or transmits a signal to a control station over telephone wires, cable, or the like. Most prior art security systems used hard wire to interconnect the master control and the remote sensors, but such systems are expensive to install, and may be difficult to repair if damaged.

It has also been recognized that radio frequency communication links may be provided between the remote sensors and the master control unit. U.S. Pat. No. 3,713,142 of Edward H. Getchell entitled ALARM SYSTEM is an example of a security system which utilizes a radio frequency link between the remote sensors and the master control unit.

Security systems of the prior art which utilize radio frequency links between the remote sensors and the master control unit have generally been unable to provide supervision of the remote sensors. In hard wire systems, it has been conventional to periodically interrogate each of the sensors by a signal from the master control which will determine whether or not the sensor is in proper operating condition. Such systems require two-way communication, and most security systems which use radio frequency wireless communication between the sensors and the master control unit provide communication only to the master control unit. The security system disclosed in U.S. Pat. No. 3,713,142, referred to above, utilizes remote transponders as sensors, and provides two-way radio frequency communication. It is an object of the present invention to provide supervision of the remote sensors without the necessity of two-way radio frequency communication, thus reducing the cost and complexity of the remote sensors. Since a plurality of remote sensors are used in every security system, cost savings are multiplied if the cost can be reduced in the remote sensor.

In accordance with the present invention, each of the remote sensors is provided with means for randomly exciting the transmitter of that sensor in order to transmit a signal to the master control unit indicating that the remote sensor is in operating condition. Since each of the remote sensors will be at random intervals transmitting such signals, there is a possibility of the signals from one sensor interfering with the signals from another sensor. It is a further object of the present invention to provide a security system of this type which overcomes these disadvantages.

In accordance with the present invention, each of the remote sensors is provided with an encoding means to modulate the radio frequency signals transmitted by that sensor with a unique code, and the master control is provided with a storage device to receive and store the codes from each of the sensors received by the master control. The master control is also provided with means for interrogating the storage means of the master control periodically in order to determine whether or not the storage means has stored signals received from each of the remote sensors. In the event that the storage means fails to indicate that a signal has been received from each of the remote sensors, the master control is provided with an indicator to alert operating personnel to the fact that one or more remote sensors is not in operating condition.

Since each of the remote sensors originates its transmission independently of the master control and of each of the other remote sensors, the possibility of contention between the signals from the transmitters of the remote sensors exists. In accordance with the present invention, the probability of such contention is reduced to substantial insignificance by providing a plurality of transmissions from each of the remote sensors within the period between interrogation of the storage facility of the master control, and by randomly timing the transmissions of the remote sensors. The combination of multiple transmissions at random times reduces contention well below mere redundancy. Random entry to data transmission cables has been recognized as an advantage by Robert M. Metcalfe et al in U.S. Pat. No. 4,063,220 entitled MULTIPOINT DATA COMMUNICATION SYSTEM WITH COLLISION DETECTION, and in the Metcalfe system the occurrence of collision inactivates the entry to one data source. In accordance with the present invention, the remote sensors receive no signals from any other remote sensor or from the master control unit, but the present system relies upon a plurality of transmissions at random time intervals from each sensor.

Also in accordance with the present invention, each of the remote sensors transmits an identifying code unique to that sensor so that the master control unit can identify the sensor that has not reported in during the period of supervision. It is the combination of random transmission and identifying code which permits supervision of remote sensors to be achieved with a one-way wireless communication system. The signal produced by the master control may of course be encoded in a different manner and transmitted to a central station for processing, or otherwise processed, as described in U.S. Pat. No. 3,735,396 of Edward H. Getchell entitled ALARM SIGNALLING NETWORK.

Each of the remote sensors is independent of power, and utilizes battery power The security device according to the present invention also determines low battery conditions or marginal signal strength at the master control unit For a more complete understanding of the present invention reference is made to the drawings as follows.

Figure 1:
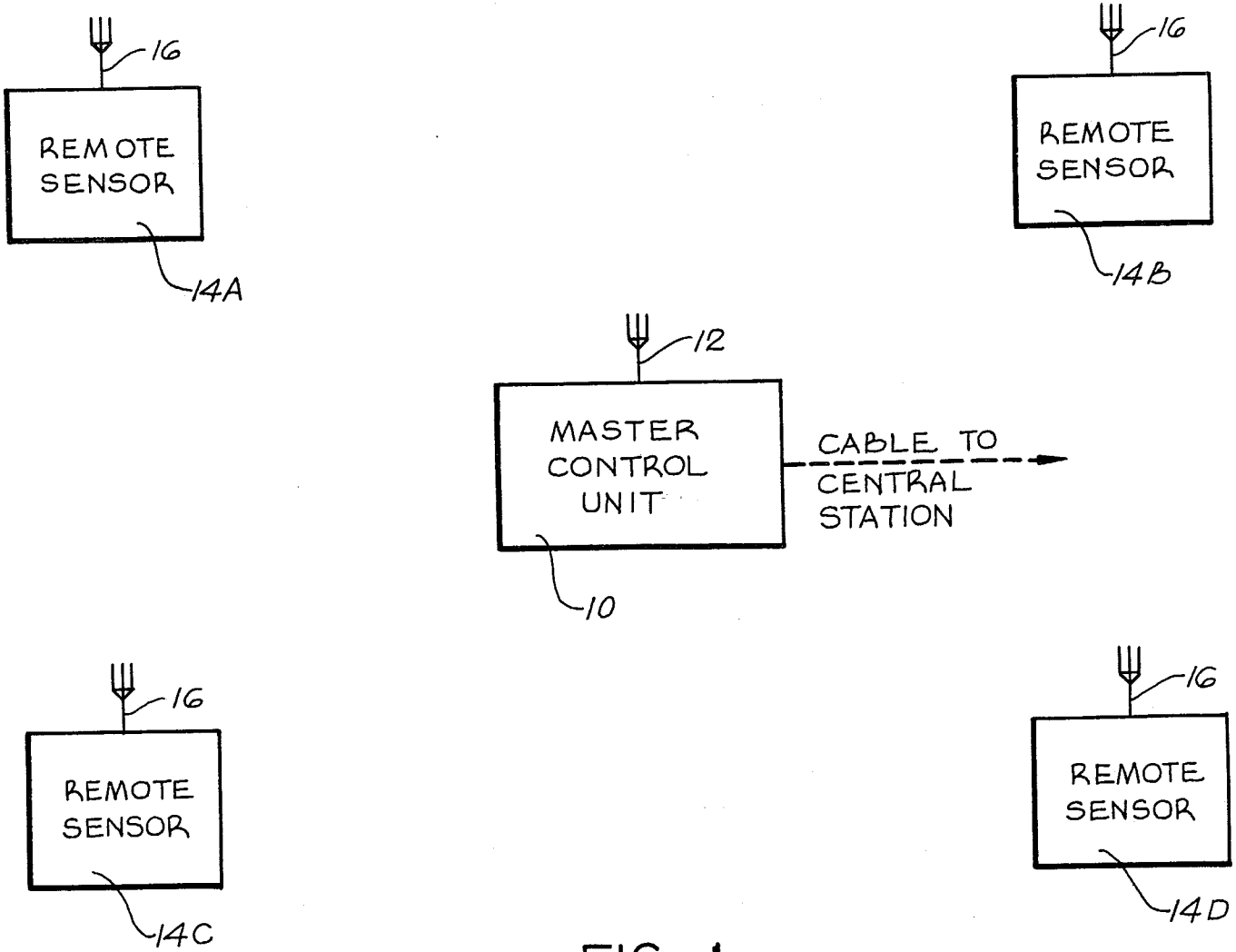
FIG. 1 is a diagrammatic view illustrating a typical security system installation according to the present invention.

FIG. 1 illustrates a master control unit 10 which is provided with an antenna 12 for coupling the master control unit to a plurality of remote sensors 14, separate sensors being designated 14A, 14B, 14C and 14D. In a typical installation, there will be a separate remote sensor 14 for each wall closure which is to be subject to protection. Each of the remote sensors 14 is self contained, that is, provided with its own battery source of power, and as illustrated in FIG. 3, each sensor 14 is provided with an antenna 16 to radiate radio frequency signals to the antenna 12 of the master control unit 10.

Each of the sensors 14 has a radio frequency oscillator 18 with an output coupled to its antenna 16. The oscillator is actuated by a random pulse generator 20, or sleep timer which is a CMOS integrated circuit. The sleep timer 20 functions as an alarm clock for the microprocessor 22 and has an output 24 connected to the microprocessor to actuate the microprocessor into modulating the RF oscillator.

In addition to the microprocessor, the remote sensor 14 has a diode programmer 26. The diode programmer permits manual encoding of the identifying code for the particular remote sensor, and causes the microprocessor 22 to modulate the RF oscillator with a series of pulses representing the code of that particular sensor. In response to actuation of the sleep timer 20, the transmitter will be actuated for a period of approximately one second, and then be silent for a period of at least thirty seconds. During the period of activation, the oscillator 18 will transmit a series of pulses representing the identity of the particular remote sensor, and any information required to be transmitted by the microprocessor. The pulses transmitted are encoded amplitude modulation, and the data and clock are combined in a phase encoded serial transmission known as Manchester coding. All sensors transmit on the same frequency.

Figure 3:
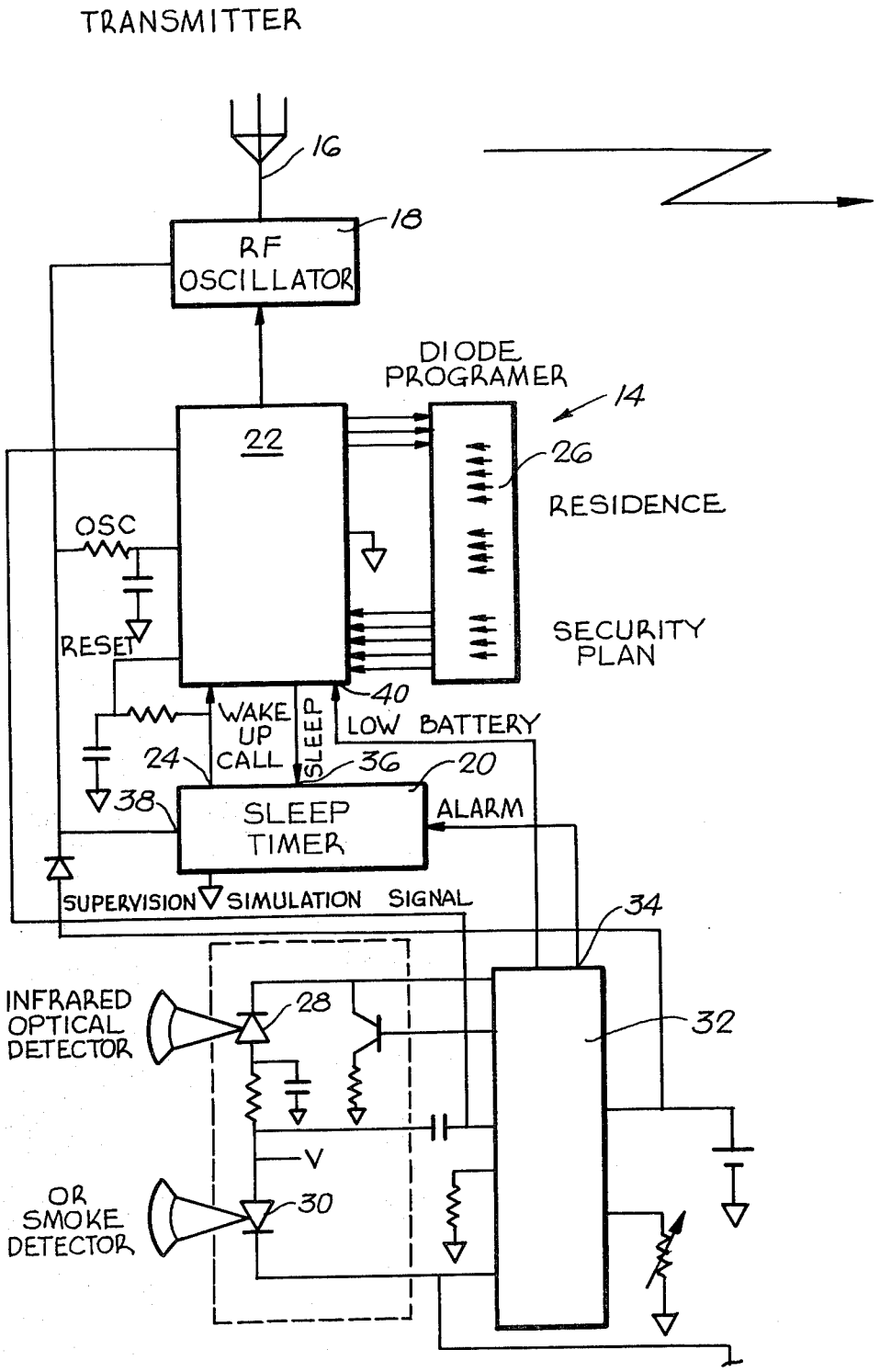
FIG. 3 is a block circuit diagram of one of the remote sensors illustrated in FIG. 1.

The remote sensor 14 illustrated in FIG. 3 utilizes an infrared optical detector to sense a condition, this infrared optical system being more fully disclosed in the patent application of the present inventor and John R. Owerko entitled SECURITY SYSTEM WITH INFRARED OPTICAL POSITION DETECTOR, filed Oct. 30, 1981, Ser. No. 06/316,868. An infrared emitting diode 28 is utilized to emit energy which is scattered by a reflector on an adjacent surface and detected by an infrared responsive diode 30. By means of an integrated circuit 32, an alarm signal is produced on an output terminal 34 in the event the scattered infrared radiation received by the detecting diode 30 is insufficient, and the output on the terminal 34 of the integrated circuit 32 is conducted to the sleep timer 20, thus causing the sleep timer 20 to actuate the oscillator 18 and send a signal to the microprocessor 22 to modulate the oscillator and produce an alarm transmission.

At the end of each transmission, the microprocessor 22 issues a sleep command which is conducted to terminal 36 of the sleep timer to initiate a sleeping mode. This mode is interrupted by an alarm signal on terminal 34 of the integrated circuit 32 or a signal on terminal 24 of the sleep timer 20 requiring operation of the microprocessor. A corresponding signal appears on terminal 38 of the sleep timer to actuate the oscillator 18. The microprocessor 22 generates the coded signal to indicate the particular remove sensor and to indicate the alarm condition. A separate coded signal may also be utilized from the microprocessor to indicate low battery voltage, the microprocessor 22 responding to a signal on terminal 40 produced by the integrated circuit 32 in response to a low voltage measurement.

Figure 2:
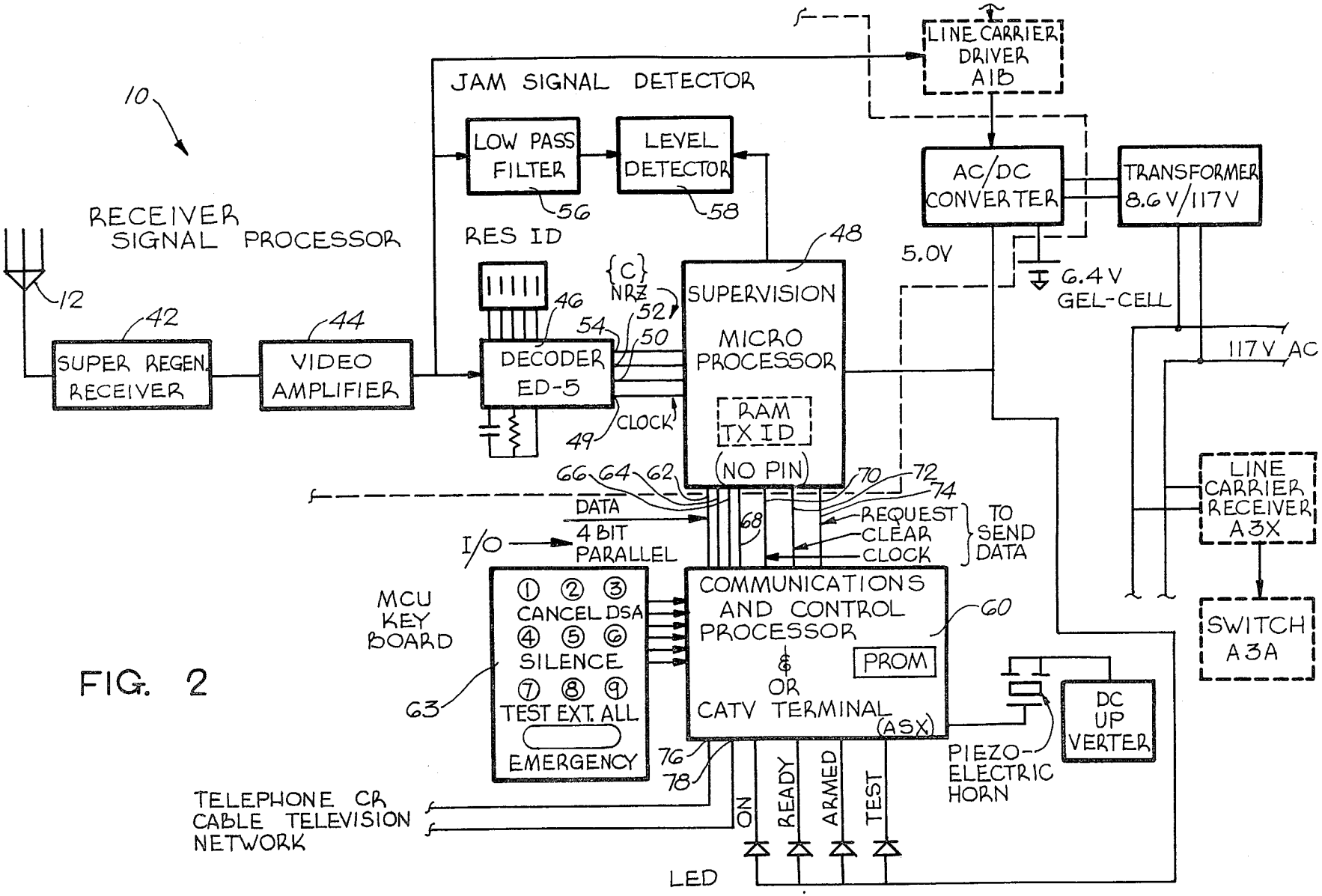
FIG. 2 is a block circuit diagram of the master control unit illustrated in FIG. 1.

The master control 10 is illustrated in FIG. 2. The antenna 12 of the master control is electrically connected to a super regenerative receiver 42 which recovers the amplitude modulation of the radio frequency signal from the remote sensors. The output of the super regenerative receiver is connected through a video amplifier 44 to a decoder 46. The output of the decoder is connected to a microprocessor 48. The video amplifier 44 amplifies and filters the recovered modulation from the super regenerative receiver 42, and the output of the video amplifier is decoded by the decoder 46 to produce a clock chain of pulses on a terminal 49 and seperate coded signals on terminals 50, 52 and 54.

The microprocessor 48 processes the information from the decoder. The microprocessor 48 contains a random access memory and the operating program for the receiver.

The output of the video amplifier is also connected to a low pass filter 56 and a level indicator 58 which form a jam signal detector. The low pass filter 56 filters the video signal and the level detector 58 detects the occurrence of a jam signal condition causing the microprocessor to indicate an alarm.

The microprocessor 48 is connected to a control processor 60. The control processor is provided with a keyboard 63 to select the function desired of the master control unit 10. The control processor 60 contains a memory, and receives from the microprocessor 48 digital data on cables 62, 64, 66 and 68 representing the processed information transmitted from the remote sensor. In addition, the control processor receives a clock signal on cable 70, a clear signal on cable 72, and a request to send data on cable 74. If the output of the microprocessor 48 which appears on cables 62 through 68 requires the sounding of an alarm, the output signal from the control processor 60 will appear on terminals 76 and 78.

When the master control unit 10 receives a supervision transmission, at some random time, from one of the remote sensors, and that signal appears at a time when the input of the master control unit is not in jammed condition, that signal will be transmitted to the microprocessor 48. The microprocessor stores the identification code of the remote sensor in its random access memory. Periodically, the microprocessor interrogates its random access memory to determine that all remote sensors have reported in since the last interrogation, and if one or more of the remote sensors has failed to actuate the random access memory with its identifying code, the microprocessor 48 reports to the control processor that the particular remote sensor is inoperative. If the control processor has been armed by manual actuation of the keyboard 63, an alarm signal will appear across the terminals 76 and 78. The same result will occur if the supervision signal from the remote sensor indicates a low battery condition.

Figure 4:
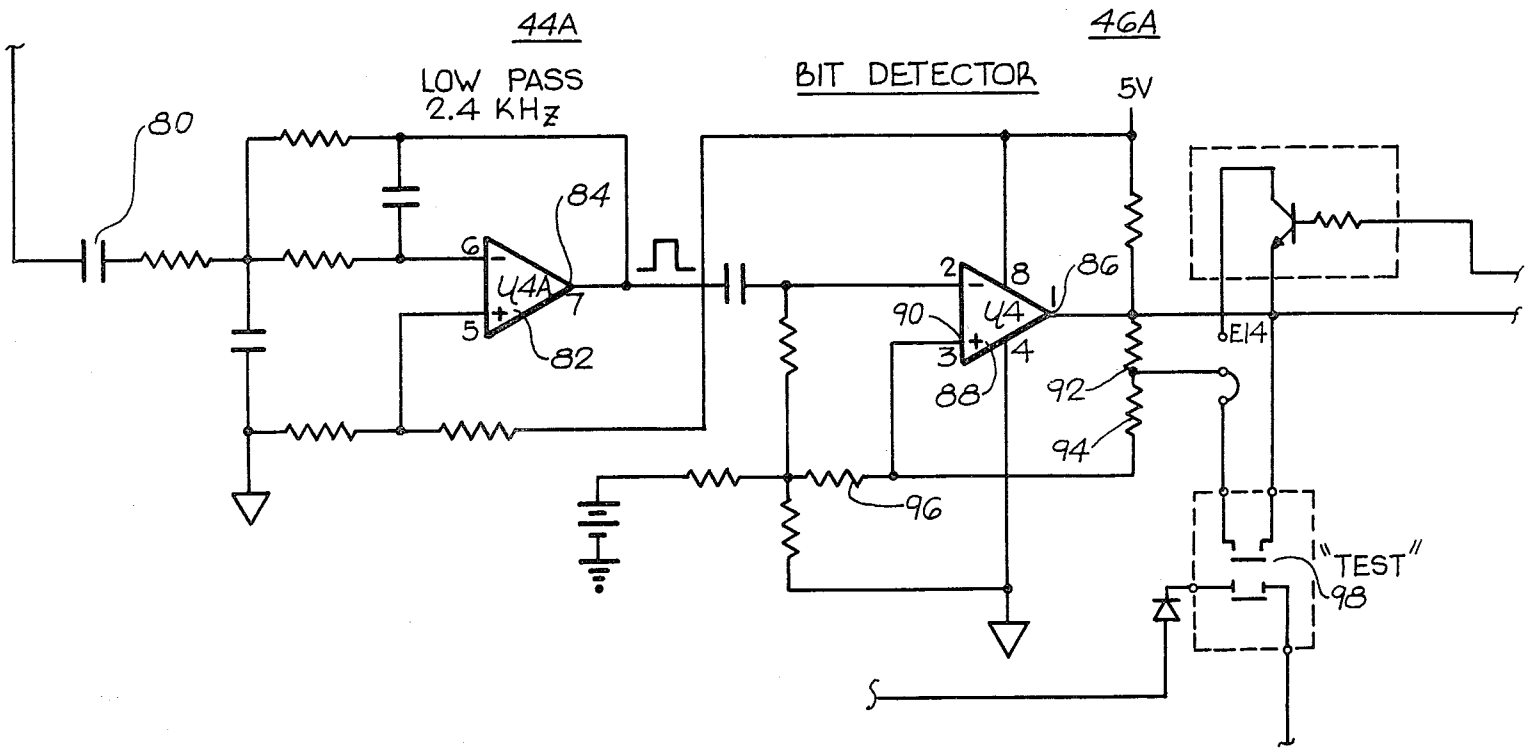
FIG. 4 is an electrical circuit diagram of a fragment of the master control unit.

It is very desirable that each of the remote sensors provide an adequate signal to the master control unit, and the circuit illustrated in FIG. 4 facilitates installation to assure this condition. FIG. 4 illustrates a particular video amplifier 44A and decoder 46A which may be substituted for the video amplifier 44 and decoder 46 of FIG. 2. The output of the super regenerative receiver is impressed upon the input of the low pass filter 44A through a capacitor 80. The low pass filter has a printed circuit 82 which functions as an amplifier, and the output of the low pass filter appears on terminal 84 of the printed circuit. The output is in the form of a stream of bits whose amplitude is proportional to the radio frequency signal at the input of the super regenerative receiver 42. The bit stream is in the form of biphase modulation, so that this alternating chain is detected by the bit detector 44A at its half amplitude on terminal 86 of a printed circuit 88 in the bit detector. A positive feedback circuit is provided between the terminal 86 and the input terminal 90 of the printed circuit 88, that feedback circuit including resistors 92, 94, and 96. As a result of the positive feedback, there is a dead zone for certain amplitudes of signals impressed on the input of the bit detector 46A, this dead zone preventing noise from false triggering the comparator during low signals. A test switch 98 is provided to short the resistor 92, thereby increasing the dead zone. In a usual installation, the dead zone will be of the order of 5 microvolts with the resistor 92 in the circuit, and 10 microvolts with the resistor shorted. As a result, satisfactory operation of the supervisory signals from remote sensors during installation with the resistor 92 shorted assures adequate signal strength at the master control unit 10 during normal operation with the resistor 92 in the feedback circuit.

The likelihood of contention as a result of supervision transmissions by the remote sensors is given by the formula $$P_A = \frac{(\tau)(n)N}{T} \times 2$$

where $\tau$ is the on time of the data burst, n is the number of replications,

N is the number of transmitters in the security plan, and

T is the supervision period.

In a particular installation, four remote sensors are employed, each of them repeating the supervision code four times during the sampling period, and the sampling period is 3600 seconds. The on time of each data burst is 15 milliseconds. Accordingly, the contention rate is one contention per ten thousand transmissions, making contention a highly unlikely occurrence.

From the foregoing specification, those skilled in the art will readily devise many modifications for the present invention, and uses for the present invention beyond that here disclosed. It is therefore intended that the scope of the present invention be not limited by the foregoing specification, but rather only by the appended claims.

The invention claimed is:

1. A supervised wireless security system comprising a sensor including a radio frequency transmitter adapted to be located at an area to be secured, and a control unit located at a distance from the sensor including a radio frequency receiver, characterized by the improved construction wherein the sensor includes repetitive means for actuating the radio frequency transmitter after the lapse of a first period of time, the duration of said first period of time varying randomly, said means of exciting the radio frequency transmitter deactuating the transmitter after the lapse of a second period of time short compared to the first period of time, and the control unit includes a random access memory coupled to the receiver for receiving and storing signals from the transmitter, said control unit also including means for sampling the memory at intervals to determine the existence of a response to a signal from the transmitter, the sampling intervals of the control unit being long compared to the first period of time.

2. A supervised wireless security system comprising the combination of claim 1 wherein a plurality of sensors are employed with a single control unit, each of the sensors having the same frequency of radiation and being uniquely encoded, the memory of the control unit storing the response of the receiver to the signals transmitted by all of the transmitters, and the means for sampling the memory determines the existence of a response to signals from all of the transmitters.

3. A supervised wireless security system comprising the combination of claim 2 wherein the means for actuating each sensor includes a random signal generator connected to the transmitter, the random signal generator producing a pulse for actuating the oscillator to produce a carrier for a period of time, said sensor including an encoder electrically connected between the transmitter and the random signal generator, said encoder being activated by initiation of the pulse from the random signal generator and generating a chain of pulses during the period of actuation of the transmitter which constitute a code uniquely identifying the sensor, the chain of pulses modulating the carrier of the transmitter.

4. A supervised wireless security system comprising the combination of claim 3 wherein each sensor includes a transducer for generating one of two electrical signals responsive to the existence of a condition, said transducer being electrically connected to the encoder, and the encoder generating one of two chains of pulses responsive to the signal of the transducer, one of said chain of pulses uniquely identifying the one condition and the other of said chain of pulses uniquely identifying the other condition, the control unit including means for identifying said one chain of pulses and actuating a response means.

5. A supervised wireless security system comprising the combination of claim 4 wherein the means for identifying the one chain of pulses comprises a decoder electrically connected to a microprocessor.

* * * * *